US005865303A

United States Patent [19]

Gernhardt et al.

[11] Patent Number: 5,865,303

[45] **Date of Patent: *Feb. 2, 1999**

[54] ELECTRICAL ROCKER SWITCH

[75] Inventors: Paul Gernhardt, Northport; Serge Krzyzanowski, Flushing, both of N.Y.

[73] Assignee: Leviton Manufacturing Co., Inc.

[ * ] Notice: The term of this patent shall not extend beyond the expiration date of Pat. No. 5,570,778.

[21] Appl. No.: 853,969

[22] Filed: May 9, 1997

Related U.S. Application Data

[63] Continuation of Ser. No. 647,092, May 9, 1996, Pat. No. 5,647,479.

[51] Int. Cl.[6] ..... H01H 21/24

[52] U.S. Cl. ..... 200/557; 200/293; 200/553

[58] Field of Search ..... 200/557, 293, 200/553, 554, 555, 556, 558, 559, 560, 561, 562, 563, 339, 302.3

[56] References Cited

U.S. PATENT DOCUMENTS 1,782,780 11/1930 Hafemeister .
2,570,281 10/1951 Russell et al. .
2,899,513 8/1959 Schmidt .
2,939,926 6/1960 Lamaudiere .
3,070,846 1/1963 Tuteishi .
3,172,972 3/1965 Schleicher .
3,185,787 5/1965 Deibel et al. ..... 200/556
3,300,605 1/1967 Ramsing et al. .
3,354,275 11/1967 Schleicher .
3,532,846 10/1970 Schumacher .
3,770,920 11/1973 Pollak .
3,917,921 11/1975 Jakubauskis .
4,612,422 9/1986 Rose et al. .
5,165,529 11/1992 Fujiyoshi .

*Primary Examiner*—David J. Walczak
*Attorney, Agent, or Firm*—Paul J. Sutton

[57] ABSTRACT

An electrical rocker switch having a clam-shell like in which a rocker is pivotally mounted. A unitary multi-function operating assembly fabricated from spring stock materials which operates as an over-center spring to establish two rest positions for the rocker. A trifurcated second end of the operating assembly provides springs to urge the contact assembly into intimate engagement with the boss on the underside of the rocker. Cross-members of the operating assembly bear movable contacts which selectively engage fixed contacts on the housing to complete external electrical circuits connected to the operating assembly and fixed contacts. An additional housing can be placed about the clam-shell like housing to seal the switch from the environment.

7 Claims, 4 Drawing Sheets

ELECTRICAL ROCKER SWITCH

This is a continuation of application Ser. No. 08/647,092 filed on May 9, 1996, now U.S. Pat. No. 5,647,479.

BACKGROUND OF THE INVENTION

1. Field of the Invention

The invention is directed to electrical toggle rocker-type switches and more particularly to a simple switch which employs a unitary operating assembly to establish the two rest positions of the rocker, to insure intimate contact between the assembly and the rocker and to bear and position one or more movable contacts with respect to one or more fixed contacts.

2. Description of the Prior Art

In general toggle action switches require a number of discrete components in order to function. They generally have the toggle, either lever or rocker, a spring to hold the toggle in each of its two rest positions, one or more movable contacts supported in the housing of the switch, and a device responsive to the movement of the toggle for moving the moving contacts into contact with the fixed contacts. Each of these separate elements must be properly positioned and moved to make and break the related electrical circuits.

The patent to Hafemeister, U.S. Pat. No. 1,782,780 issued Nov. 19, 1924 shows a toggle switch employing a finger piece 15 in which are embedded two straps 16. A coiled compression spring 31 is placed on a guide rod 32 anchored at one end by a collar 19 and at its other by notch 25 in body portion 21. Movable arms with movable contacts are made to bridge fixed contacts 42 to close a circuit as in FIG. 1 or moved to open the circuit as shown by FIG. 2. Ears 13 are the stops for body portion 21.

Russell et al, U.S. Pat. No. 2,570,281 issued Oct. 9, 1951 uses a molded handle with a depending post to compress a helical spring 22 carried by a yoke 15. Fixed contacts 32, 34 are bridged by a movable contact in the form of a rod carried by yoke 15. The final position of handle 20 depends upon the fixed stops 24, 25.

In U.S. Pat. No. 2,899,513 issued Aug. 11, 1959 to Schmidt, an operating lever 34 is held in positioned by a compressed coil spring 47 held between cap 46 and a tongue 33*a* on a separate contact plate 33. Contacts are carried by the lever 34 and enclosure (contacts 26, 28, 56, 58) and circuits are completed between these contacts under control of lever 34 and contact plate 33.

Lamaudiere, U.S. Pat. No. 2,939,926 issued Jun. 7, 1960 employs a control knob 13, in which is mounted a compression spring 15, which controls the position of a rocker 21 which carries movable contact piece 24 to contact fixed contacts 25, 26. All of the elements are discrete.

Schleicher, U.S. Pat. No. 3,172,972, issued Mar. 9, 1965 shows a switch with a lever 20 which has a spring-operating finger 26 which compresses a coiled compression spring 28 seated on spring-holding stud 29 molded to the bottom of base 10. Movable contact operating cams 24 operate movable contact arm 17 to move contact 17C away from fixed contact 18C or allow contact with it.

In U.S. Pat. No. 3,300,605 issued Jan. 24, 1967 to Ramsing et al, lever 18 is pivoted to the housing and carries a projection 21 having a lever recess 33. Movable contacts 35, 36 are carried on movable conductive arm 34 to engage fixed contacts 37 or 38. The blade 31 and spring 25, 30 are required to operate arm 34 and fix the position of lever 18 as well as control the circuits connected.

Schleicher, U.S. Pat. No. 3,354,275 issued Nov. 21, 1967 shows a lever operated switch employing a leaf spring 59 and roller 61 to control the position of operating lever member 11. Camming lugs 84 and 85 are provided to separate movable contact 28 from fixed contact 27 against the spring action of the movable contact while movable contact 44 remains in contact with fixed contact 48 in one position and vice-versa in the other. Thus contacts 28 and 44 have to provide their own springs in addition to spring 59 for lever 11.

U.S. Pat. No. 3,532,846 issued Oct. 6, 1970 to Schumacher shows a lever operated switch with a coil spring 112 to control the position of trigger 110. A spring arm 82 supports movable contact 84 and attempts to move such contact into contact with fixed contact 62 depending upon the position of trigger cams 114 on trigger 110.

Poliak, U.S. Pat. No. 3,770,920 shows a switch with a rocker 24 employing a coil spring 65 to urge the trunnions 56 into pivotal engagement with notches 57 on cover 25 and to urge the trunnions 51 of the movable contact arm 40 into the notches 50 on common contact 41. Spring 65 also urges rocker 24 towards it rest positions so that split cams 66 can urge the lower end of the movable arm 40 into engagement with fixed contacts 38.

SUMMARY OF THE INVENTION

The instant invention overcomes the complex manufacturing and assembly of many small parts to provide a simple, easily manufactured and assembled rocker type switch which can be used as a single pole, single throw or single pole, double throw switch. A single, unitary operating assembly provides all of the necessary switch operating functions previously provide by a number of separate assemblies. The unitary operating assembly provides a spring function to seat the fulcrum of the rocker panel against the housing pivot point and provide over center rocker rest positions for the rocker. The unitary operating assembly carries the movable switch contacts and is directly connected to one line of the circuit to be closed. It is a object of the instant invention to provide a simple, easily manufactured and assembled switch.

It is an object of the instant invention to provide a simple, easily manufactured and assembled switch which employs a unitary operating assembly.

It is another object of the invention to provide a unitary operating assembly which includes the mounting of the rocker, the establishment of rocker rest positions, mechanical and electrical contact between movable and fixed contacts and direct electrical contact with the movable contacts.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
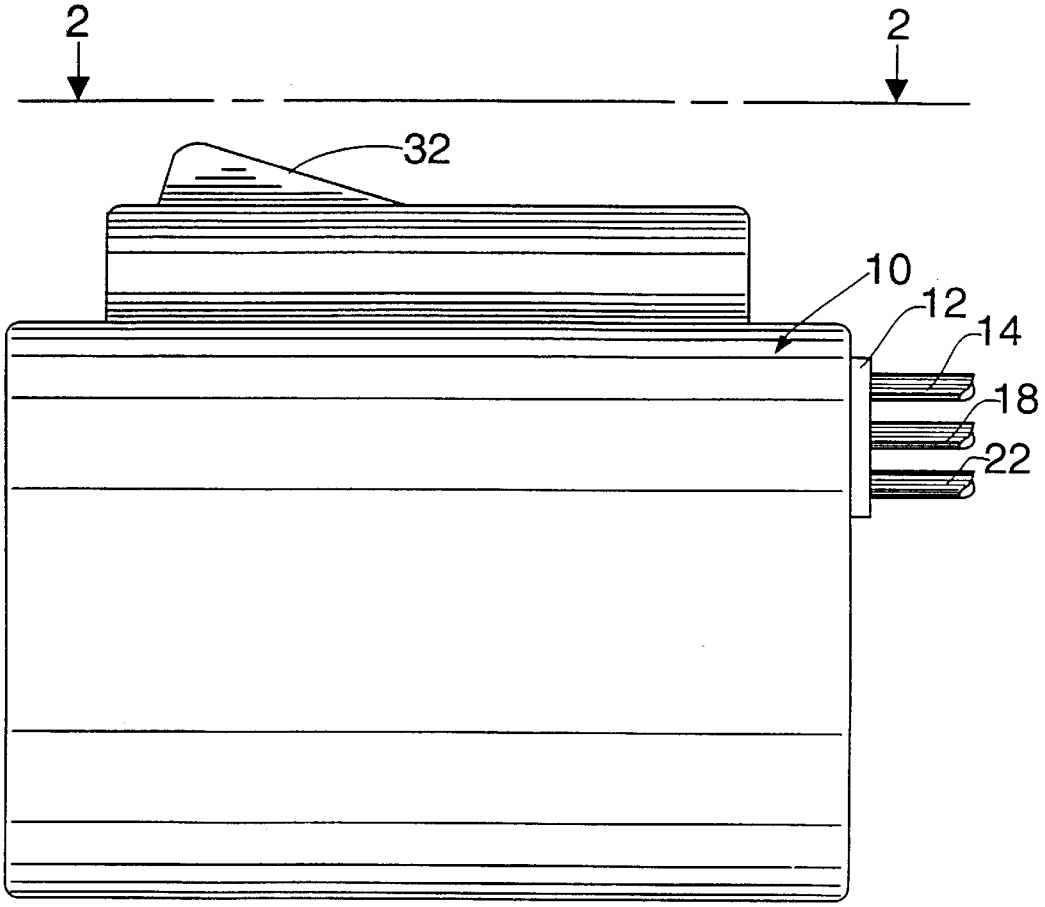
FIG. 1 is a side elevational view of a switch constructed in accordance with the concepts of the invention.

Turning now to FIGS. 1 to 6 there is shown a rocker switch 30 of which only a portion of the rocker 32 is shown above an environmental enclosure 10 in which rocker switch 30 may be placed. A moisture and foreign matter seal 12 allows electrical conductors 14, 18 and 22 to exit the enclosure 10 without permitting foreign matter or moisture to enter.

Rocker switch 30 is made up of two mirror image housing portions or side walls 34, 36. For ease in describing the housing, the description will generally be directed to housing portion or side wall 34. A pin 40 of a generally diamond shape projects from a circular boss 38. A socket 44, having a circular cross-section of a diameter slightly less than the width of pin 40 across its face between two opposite apexes is placed in a second boss 42. To assemble housing portions 34, 36, the pin 40 of portion 34 is inserted in socket 44 of portion 36. In a similar fashion, pin 40 of portion 36 is inserted into socket 44 of portion 34 and the portions 34, 36 are pressed towards one another so that the apexes bite into the material of bosses 42 and hold portions 34, 36 in assembly. Serrations can be added at the apexes or along the faces of pins 40 to improve its grip. The portions 34, 36 can be pried apart if necessary.

A triangular opening 46 having an upwardly facing pivot point 48 and a flat base 50 is placed in each of the side walls 34, 36. Placed in each of the triangular openings 46 is one of the triangular trunnions 52 of rocker 32. Each of the triangular trunnions 52 has knife edge 54 which engages the pivot point 48 of opening 46 to permit the rocker 32 to rotate about knife edge 54. The base 56 of each of the trunnions 52 is arcuate and the trunnion has an altitude less than that of the opening 46 so that the trunnions 52 can pivot about pivot point 48 without base 56 engaging aperture base 50. The engagement of trunnion side surfaces 58, 60 with triangular opening 46 side surfaces 62, 64, respectively, limit the rotation of the trunnions 52 with respect to side walls 34, 36.

The top surface 80 of rocker 32 is generally concave with the low point in the center above the knife edges 54 of the trunnions 52. One of the free ends, 82, 84 of rocker 32 will extend above the housing 10 depending upon the state of switch 30. The end 82, 84 extending above housing 10 will be depressed to change the state of switch 30.

A raised, molded terminal pocket 70 is formed to each side of the vertical center line of the side walls 34, 36. The terminal pocket 70 has a slot 72 into which is fit terminal support plate 76 which supports fixed contact 78 thereon. A further slot 74 in terminal pocket 70 permits a welding tab 81 of terminal support plate 76 to extend beyond pocket 70 to permit the bared end 16 of electrical conductor 14 to be welded thereto. A fixed contact 78 is mounted upon terminal support plate 76 by means of an aperture as shown in FIG. 2 or it may be welded, braised or otherwise attached to plate 76.

Figure 2:
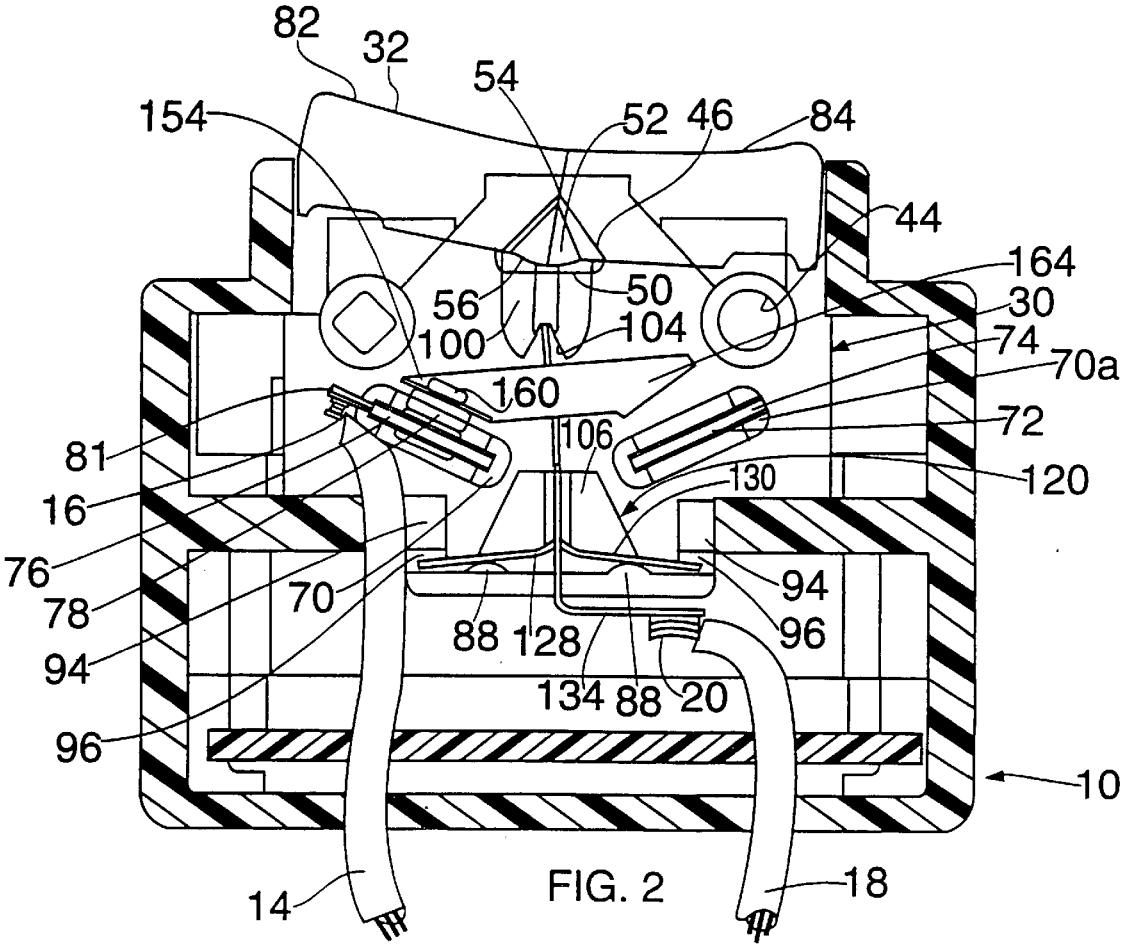
FIG. 2 is a side elevational view, partly in section, of the switch of FIG. 1 taken along the lines 2—2 with conductors added.
Figure 7:
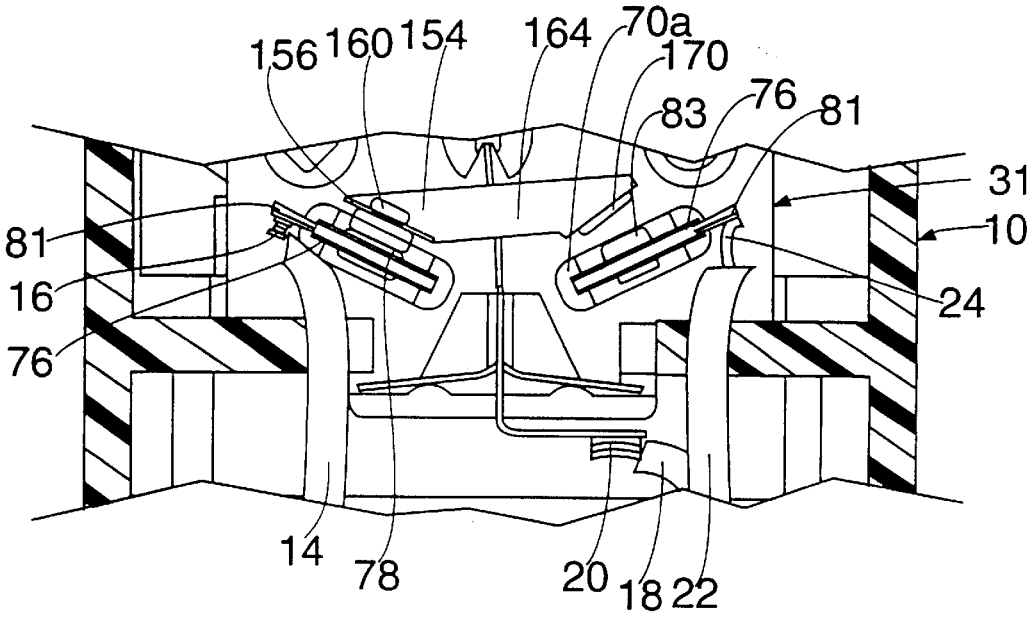
FIG. 7 is a fragmentary, side elevational view, of the switch of FIG. 2 arranged as a single pole, double throw switch.

The arrangement in FIG. 2 is for a single pole, single throw switch. A single pole, double throw switch 31 can be realized as shown in FIG. 7 by adding a further support plate 76 to the pocket 70 to the right of the vertical center line, and by adding a contact 82 to such plate 76 and welding the bared end 24 of conductor 22 to it. As will be described below a second movable contact will also be required so that a circuit can be completed.

Returning to FIG. 3, a shelf 84 extends perpendicularly from the bottom edge of side wall 34 in the same direction as bosses 38, 42. The shelf 84 is slotted as at 86 at its mid-point. A projection 88 in the form of a half-cylinder is position on the top surface 90 of shelf 84 midway between the shelf free end 92 and slot 86. A projection 94 extends over shelf 84 top surface 90 adjacent free end 92 and is separated from shelf 84 top surface 90 by a slot 96. It should be appreciated that side wall 36 will have a similar structure on the left interior side opposite flat portion of shelf 84 between slot 86 and free end 98.

Above the shelf 84 is a support member 106 in the shape of a truncated triangle with a slot 112 extending from the flat top 108 thereof towards but short of the base 110.

Extending below the rocker 32 from the inside surface 81 at the midpoint is toggle element 100 which has a reinforcement rib 102 to each side (only one is visible in FIG. 6) and a vee notch 104 at its free end.

Figure 4:
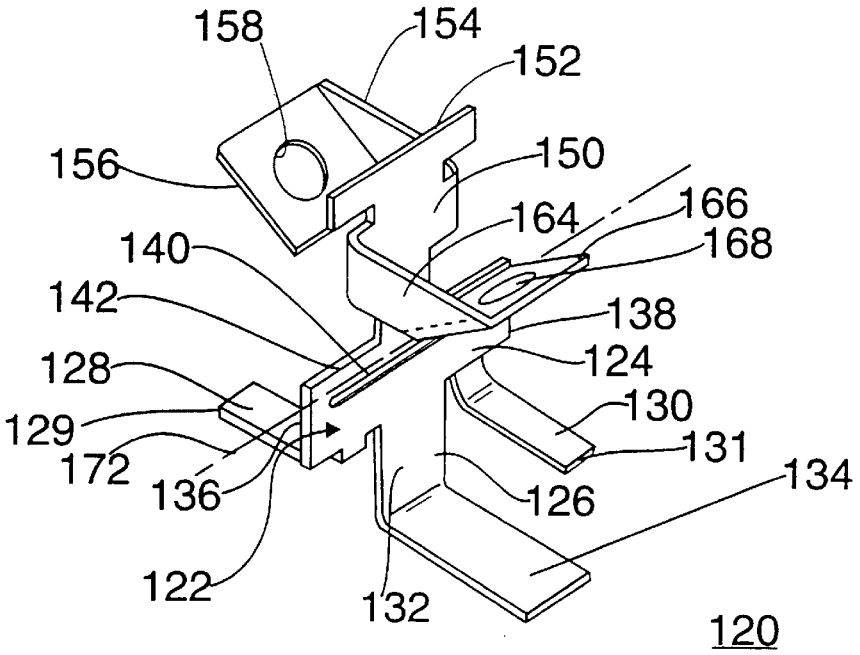
FIG. 4 is an enlarged front, left perspective view of the unitary operating assembly of FIG. 3.
Figure 3:
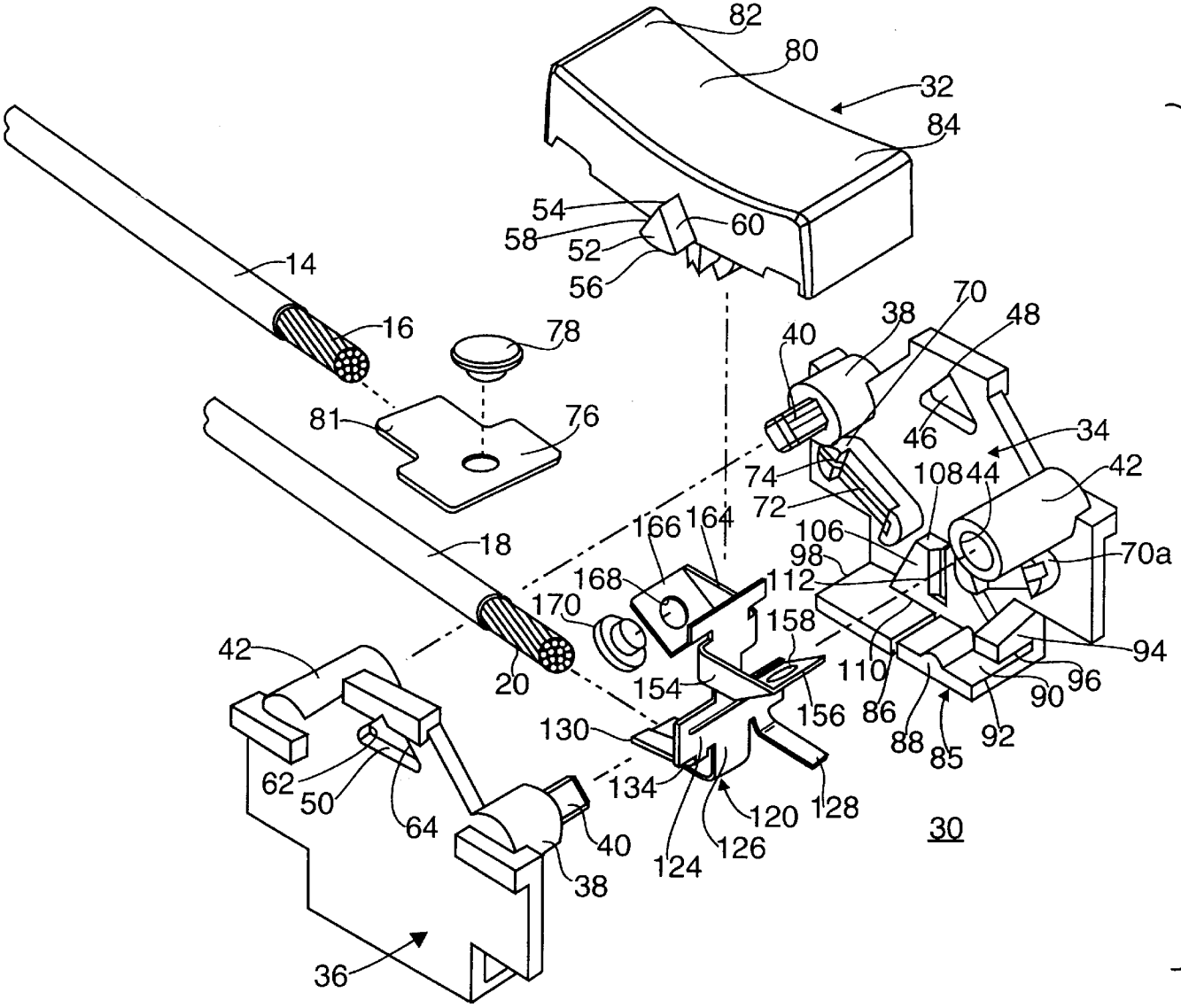
FIG. 3 is an exploded front, right perspective view of the switch of FIG. 2 with the outer environmental shell removed to better display the switch components.
Figure 5:
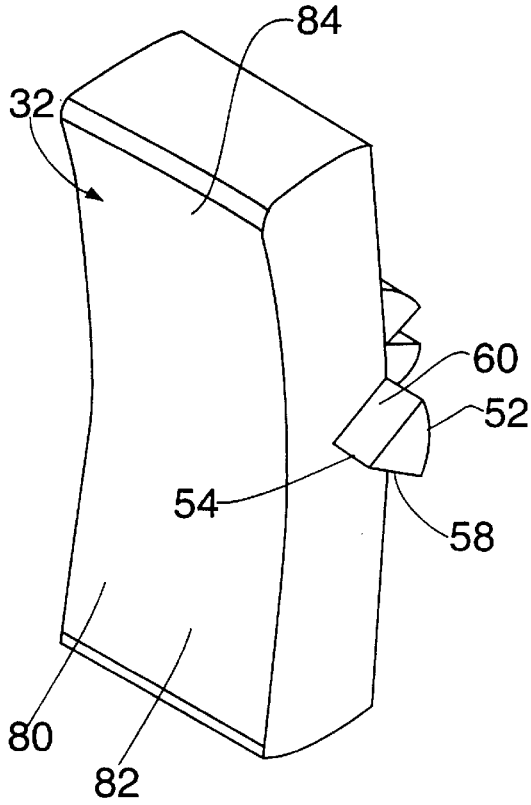
FIG. 5 is right, front perspective view of the rocker of FIG. 1.
Figure 6:
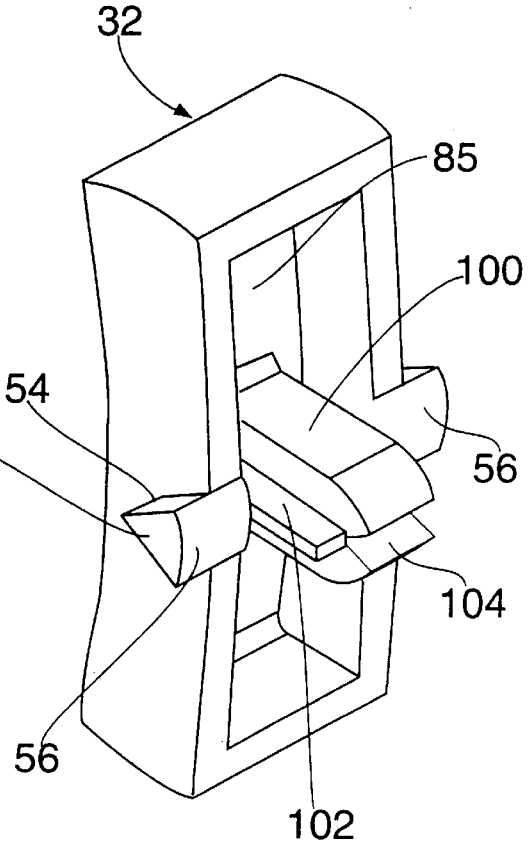
FIG. 6 is a right, rear perspective view of the rocker of FIG. 1.

Referring now to FIGS. 2, 3 and 4 the details of the operating assembly 120 can be appreciated. The entire operating assembly 120 is fabricated from a single blank of spring material such as copper, berylium, a copper-berylium alloy or the like. The central body portion 122 has a generally T-shape with a cross-member 124 and an extending member 126. Spring arms 128, 130 are formed from the member 126 making the remaining member 132 narrower than cross-member 124. Member 132 is bent at a right angle to central body portion 122 to provide a welding tab 134 to which the bared conductor 20 of insulated conductor 18 may be welded as shown in FIG. 2. The width of cross-member 124 is such that it bridges the space between housing portion 34, 36. Edge 136 of cross-member 124 enters slot 112 of support member 106 and edge 138 enters a similar slot 112 on the inside wall of housing portion 36 (not shown). Spring arms 128, 130 are bend away the from plane of central body portion 122 at an acute angle of about 80 degrees. Spring arm 130 is positioned on shelf 84 so that its free end 131 enters the slot 96 between top surface 90 of shelf 84 and the bottom surface of projection 94, and the main body of spring arm 130 rests upon projection 88. In a similar manner spring arm 128 is positioned on shelf 84 top surface 90 with its free end 129 in gap 96 and the main body portion resting upon projection 88 of housing portion 36. The effect of the two spring arms 128, 130 is to resist any downward forces upon the operating assembly 120 applied by toggle element 100 and apply an upward bias to such toggle element 100.

Cross-member 124 has a slot 140 extending through much of its width but short of edges 136, 138. Extending from edge 142 upwardly is the contact portion of operating assembly 120. A contact central portion 150 extends to a flat edge 152 which will be positioned within Vee notch 104 of toggle element 100 to transmit forces to the operating assembly 120 from the toggle element 100 and from the operating assembly 120 to the toggle element 100.

Extending from one edge of contact central portion 150 is an arm 154 the end of which is bent at approximately 35° to the plane of central portion 150 to form contact support tab 156 in which is placed on aperture 158 to receive contact 160 which may be of copper, a copper alloy or silver. Extending from the opposite edge of contact central portion 150 is a second arm 164, the end of which is bent at approximately 35° to the plane of central portion 150 to form a second contact support tab 166 in which is placed an aperture 168 to receive a second contact 170 as shown in FIG. 7. The entire contact central portion 150 pivots about pivot axis 172 through cross-member 124 above slot 140. In so doing the contact central portion 150 above pivot axis 172 operates as an over center toggle spring. Thus as long as right end 84 of the rocker 32 remains as shown or providing left end 82 is not pushed down to move central portion 150 beyond the central vertical axis of switch 30 the central portion 150 is stable and will remain in or return to the position as shown. If, however, the left side 82 of rocker 32 is depressed to move the central portion 150 beyond the central vertical axis, the central portion 150 will continue to move to the right of FIG. 2 until it reaches a stable point where it will remain until the right side 84 of rocker 32 is depressed to return the central portion 150 to the position shown in FIG. 2.

Assuming rocker 32 is in the position shown in FIG. 2, movable contact 160 is in contact with fixed contact 78 and a circuit is completed from conductor 14 to conductor 18. Pushing on the left side 82 of rocker 32 causes rocker 32 to pivot counter-clockwise with respect to housing portions 34, 36. Knife edges 54 of the trunnions 52 pivoting in the pivot points 48 of the triangular openings 46. Contact between knife edges 54 and pivot points 48 are assured by the upward bias of operating assembly 120. Unless stopped sooner, downward movement of left end 82 of rocker 32 will end when trunnion sides 60 engage triangular openings sides 64. Toggle element 100 will move central portion 150 of operating assembly 120 beyond the central vertical axis in a clockwise direction. This will cause central portion 150 to pivot about axis 172 separating movable contact 160 from fixed contact 78. It will cause tab 166 to move close to pocket 70*a* but will make no electrical contact because no movable contact is located on tab 166 and no fixed contact with conductor attached is found in pocket 70*a*. the switch 30 is thus considered a single pole, single throw switch having an on and an off position. The position when movable contact 160 does not engage fixed contact 78 is considered the off position while contact between them is the on position.

FIG. 7 shows an arrangement similar to FIG. 2 but with a contact 83 on support plate 76 in pocket 70*a* coupled to the bared end 24 of conductor 22. A movable contact 170 is attached to tab 166. By this arrangement circuits can be completed between conductor 18 and conductor 14 or conductor 22. This arrangement is termed a single pole, double throw switch and there is no off position.

While there have been shown and described and pointed out the fundamental novel features of the invention as applied to the preferred embodiment, it will be understood that various omissions and substitutions and changes of the form and details of the device illustrated and in its operation may be made by those skilled in the art, without departing from the spirit of the invention.

The embodiment of the invention in which an exclusive property or privilege is claimed as defined as follows:

We claim:

1. A housing for an electrical rocker switch, said housing having a vertical center line about which said housing is symmetrical comprising:

a) a first and second halves, each half being a mirror image of the other half, said first and second halves are capable of being assembled into a single housing;

b) two bosses positioned along a top edge of each of said first and second halves adjacent marginal edges of said first and second halves;

c) two generally diamond-shaped assembly pins having a width dimension, a height dimension and a diagonal dimension, said two pins having a first end and a second end;

d) a cylindrical bore in each of said bosses, said bores having a diameter less than said diagonal dimension of said assembly pins;

e) each assembly pin inserted into corresponding cylindrical bores on each of said first and second halves to assemble said halves into a single housing.

2. A housing, as defined in claim 1, wherein an outer surface of said assembly pins is serrated to intimately engage the boss about said bores.

3. A housing for an electrical rocker switch, said housing having a vertical center line about which said housing is symmetrical comprising:

a) first and second halves, each half being a mirror image of the other half, said first and second halves are capable of being assembled into a single housing;

b) at least one terminal pocket on an interior wall of each of said first and second halves; each of said at least one terminal pocket having a slot there to receive one marginal edge of at least one terminal support plate;

c) at least one terminal support plate having two spaced apart marginal edges, said terminal support plate having a fixed electrical contact thereon and capable of being joined to a first electrical conductor, said at least one terminal support plate bridging said interior walls of said first and second halves with each of said two edges in the slot in one of said associated terminal pockets.

4. A housing, as defined in claim 3, wherein said at least one terminal pocket is two terminal pockets on the interior wall of each of said first and second halves each of said two terminal pockets having a slot therein to receive one marginal edge of a terminal support plate; said at least one terminal support plate is two terminal support plates each having two spaced apart marginal edges, each of said two terminal support plates having a fixed electrical contact thereon and capable of being joined to one of two electrical conductors, each terminal support plate bridging said interior walls of said first and second halves with each of said two edges in the slot in one of said associated terminal pockets.

5. A housing for an electrical rocker switch, said housing having a vertical center line about which said housing is symmetrical comprising:

a) first and second halves, each half being a mirror image of the other half, said first and second halves are capable of being assembled into a single housing;

b) a triangular shaped opening in each of said first and second halves, the apex of said triangular shaped opening pointed towards a top edge of each of said first and second halves;

c) a rocker member having an operating surface and a first side wall and a second side wall, a first triangular trunnion on said first side wall extending outwardly therefrom, an apex of said first triangular trunnion extending upwardly towards said operating surface, a second triangular trunnion on said second side wall extending outwardly therefrom, an apex of said second triangular trunnion extending upwardly towards said operating surface;

d) said rocker member placed between said first and second halves prior to assembly and after assembly of said first and second halves, said first trunnion extends through a triangular shaped opening in one of said first and second halves and said second trunnion extends through a triangular shaped opening in the other of said first and second halves.

6. A housing, as defined in claim 5, further comprising spring means engaging said rocker member and urging said rocker member towards the top of said housing and causing engagement of the apex of said first trunnion with the apex of a triangular shaped opening in one of said first and second halves and the apex of said second trunnion with the apex of a triangular shaped opening in the other of said first and second halves, whereby said operating surface can be made to rotate with respect to said housing.

7. A housing as defined in claim 6, wherein each of said triangular shaped openings is defined by a first and second inclined surface, said first triangular trunnion is defined by a third and fourth inclined surface and said second triangular trunnion is defined by a fifth and sixth inclined surface, the engagement of said third or fifth inclined surfaces with said first or second inclined surfaces limiting the rotation of said operating surface in a first direction and the engagement of said fourth or sixth inclined surfaces with said first or second inclined surfaces limiting the rotation of said operating surface in a second direction opposite said first direction.

* * * * *

UNITED STATES PATENT AND TRADEMARK OFFICE

CERTIFICATE OF CORRECTION

PATENT NO. : 5,865,303

DATED : February 2, 1999

INVENTOR(S) : Paul Gernhardt, et al

It is certified that error appears in the above-identified patent and that said Letters Patent is hereby corrected as shown below:

On the title page, Item [63]

delete "." (period) after 5,647,479 and insert --which is a continuation of application serial No. 08/233,581 filed April 26, 1994 which is now U.S. Patent No. 5,570,778 issued November 5, 1996.--

Signed and Sealed this

Twentieth Day of July, 1999

*Attest:*

*Attesting Officer*

Q. TODD DICKINSON

*Acting Commissioner of Patents and Trademarks*